US011562849B2

(12) United States Patent
Tomizuka

(10) Patent No.: US 11,562,849 B2
(45) Date of Patent: Jan. 24, 2023

(54) INDUCTOR

(71) Applicant: Murata Manufacturing Co., Ltd., Kyoto-fu (JP)

(72) Inventor: Yuuhei Tomizuka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 429 days.

(21) Appl. No.: 16/842,720

(22) Filed: Apr. 7, 2020

(65) Prior Publication Data

US 2020/0335265 A1 Oct. 22, 2020

(30) Foreign Application Priority Data

Apr. 18, 2019 (JP) ..... JP2019-079325

(51) Int. Cl.

| | |
|---|---|
| ***H01F 27/29*** | (2006.01) |
| ***H01F 1/20*** | (2006.01) |
| ***H01F 17/00*** | (2006.01) |
| ***H01F 41/04*** | (2006.01) |
| ***H01F 27/255*** | (2006.01) |

(Continued)

(52) U.S. Cl.

CPC ..... *H01F 27/29* (2013.01); *H01F 1/20* (2013.01); *H01F 17/0006* (2013.01); *H01F 17/04* (2013.01); *H01F 27/255* (2013.01); *H01F 27/2804* (2013.01); *H01F 41/041* (2013.01); *H01F 2017/048* (2013.01)

(58) Field of Classification Search

CPC ..... H01F 27/29; H01F 1/20; H01F 17/0006; H01F 17/04; H01F 27/255; H01F 27/2804; H01F 41/041; H01F 2017/048; H01F 1/26; H01F 27/292

See application file for complete search history.

(56) References Cited

U.S. PATENT DOCUMENTS

2013/0255071 A1* 10/2013 Muneuchi ..... H01F 27/292 29/605

2018/0144859 A1 5/2018 Araki

FOREIGN PATENT DOCUMENTS

JP 2010-087240 A 4/2010
JP 2017-123433 A 7/2017

(Continued)

OTHER PUBLICATIONS

An Office Action; "Notice of Reasons for Refusal," mailed by the Japanese Patent Office dated Oct. 26, 2021, which corresponds to Japanese Patent Application No. 2019-079325 and is related to U.S. Appl. No. 16/842,720 with English translation.

*Primary Examiner* — Hafizur Rahman
*Assistant Examiner* — Kimberly E Glenn
(74) *Attorney, Agent, or Firm* — Studebaker & Brackett PC

(57) ABSTRACT

An inductor includes a coil that is constituted by a conductor having a coating layer and includes a winding portion where the conductor is wound and an extended portion extended from the winding portion, a base body that envelops the coil and is constituted by a magnetic body containing magnetic powder and resin, and an outer electrode that is arranged on a surface of the base body and connected to the extended portion. The extended portion of the coil includes a conductor portion that does not have the coating layer in an end portion of the extended portion, and the conductor portion includes a first region connected to the outer electrode and a second region in contact with the magnetic body.

14 Claims, 3 Drawing Sheets

(51) Int. Cl.
*H01F 27/28* (2006.01)
*H01F 17/04* (2006.01)

(56) References Cited

FOREIGN PATENT DOCUMENTS

| | | | |
|---|---|---|---|
| JP | 2017-201718 | A | 11/2017 |
| JP | 2018-085459 | A | 5/2018 |

* cited by examiner

INDUCTOR

CROSS-REFERENCE TO RELATED APPLICATION

This application claims benefit of priority to Japanese Patent Application No. 2019-079325, filed Apr. 18, 2019, the entire content of which is incorporated herein by reference.

BACKGROUND

Technical Field

The present disclosure relates to inductors.

Background Art

A known inductor has a structure in which a coil constituted by a conducting wire having a coating layer is embedded in a base body containing magnetic powder and resin, and an end portion of an extended portion of the coil is exposed from the base body. Japanese Unexamined Patent Application Publication No. 2017-123433 proposes a manufacturing method of an inductor, in which a plurality of coils constituted by conducting wires including coating layers are aligned and embedded in a magnetic powder containing sheet and after press forming, a base body is formed by cutting the sheet with a dicing machine so that an extended portion of the coil is exposed from a surface of the base body.

According to the method in which a base body is obtained by exposing an extended portion of a coil from a surface of the base body by cutting with a dicing machine and in the exposed portion of the extended portion, a coating layer that surrounds the cross section of the conductor is present. In a case where a plating process is performed on the surface of the base body, the plating formed on the surface of the base body and the plating formed on the conductor are separated by the coating layer and junction between the platings can be inhibited accordingly. Thus, the plating needs to be grown and thickened until the plating formed on the surface of the base body and the plating formed on the conductor become integrated. As a result, productivity may be decreased.

SUMMARY

Accordingly, the present disclosure provides an inductor excellent in productivity, in which the plating formed on the surface of a base body and the plating formed on a conductor can be easily integrated.

An inductor includes a coil that is constituted by a conductor having a coating layer and includes a winding portion where the conductor is wound and an extended portion extended from the winding portion, a base body that envelops the coil and is constituted by a magnetic body containing magnetic powder and resin, and an outer electrode that is arranged on a surface of the base body and connected to the extended portion. The extended portion includes a conductor portion that does not have the coating layer in an end portion of the extended portion. The conductor portion includes a first region connected to the outer electrode and a second region in contact with the magnetic body.

According to an aspect of the present disclosure, an inductor excellent in productivity can be provided, in which the plating formed on the surface of a base body and the plating formed on a conductor can be easily integrated.

Other features, elements, characteristics and advantages of the present disclosure will become more apparent from the following detailed description of preferred embodiments of the present disclosure with reference to the attached drawings.

DETAILED DESCRIPTION

Figure 1:
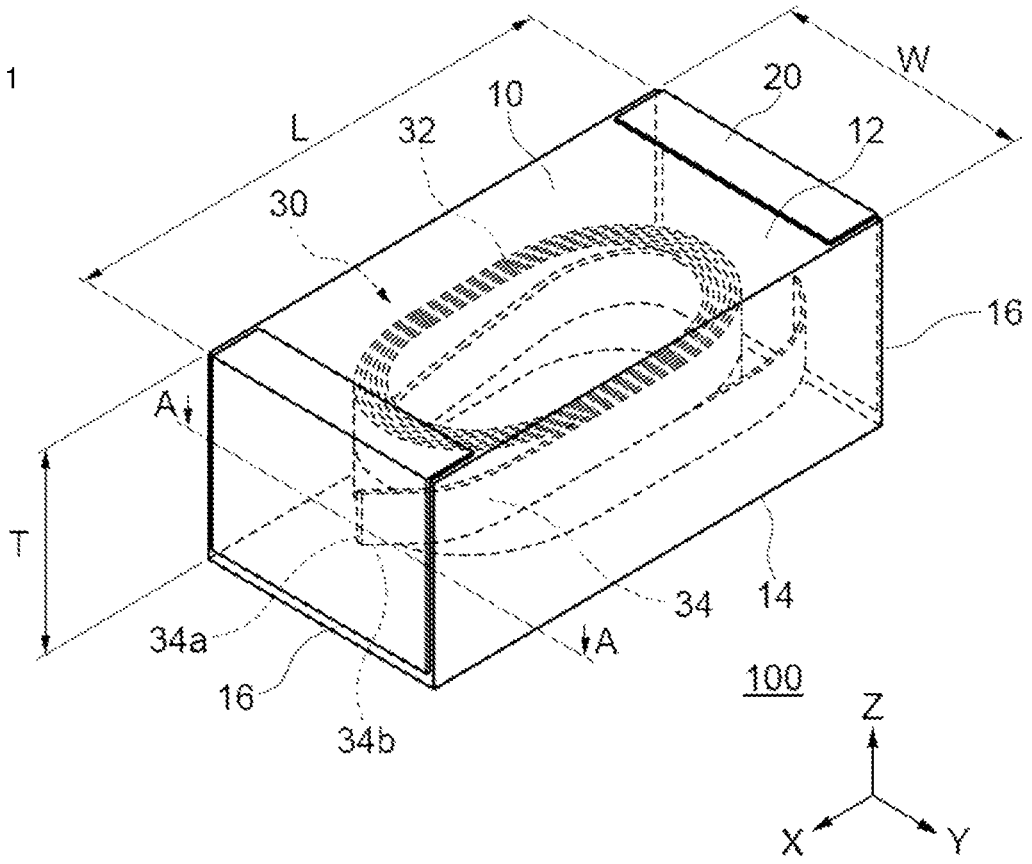
FIG. 1 is a partial transparent perspective view taken from the side of a mounting surface of an inductor according to a first embodiment.

An inductor includes a coil that is constituted by a conductor having a coating layer and includes a winding portion where the conductor is wound and an extended portion extended from the winding portion, a base body that envelops the coil and is constituted by a magnetic body containing magnetic powder and resin, and an outer electrode that is arranged on a surface of the base body and connected to the extended portion. The extended portion includes a conductor portion that does not have the coating layer in an end portion of the extended portion. The conductor portion includes a first region connected to the outer electrode and a second region in contact with the magnetic body.

The second region in contact with the magnetic body is provided in the end portion of an extended portion so as to be continuous with the first region connected to an outer electrode. Accordingly, inhibition by the coating layer of the conductor on junction between the plating formed on the surface of the base body and the plating formed on the conductor can be suppressed, and without thickening the plating, the plating formed on the surface of the base body and the plating formed on the conductor can be joined easily. Thus, productivity of the inductor can be enhanced.

The conductor portion may include the first region on a surface that intersects a length direction of the conductor. For example, the first region is formed by cutting an end portion of the conductor, and productivity can be further enhanced accordingly.

The conductor portion may include the first region on a surface that extends in a length direction of the conductor. Accordingly, the connection area between the outer electrode and the coil conductor is large and reliability can be increased.

The conductor portion may include the second region in a position where a depth from a surface of the base body is larger than a value of an average particle diameter D50 of the magnetic powder. Accordingly, the second region where the conductor and the magnetic body come into contact can be formed with higher reliability.

The second region may include a region where the magnetic powder and the conductor come into contact. Accordingly, the second region where the conductor and the magnetic body come into contact can be formed with higher reliability.

The outer electrode may include a copper plating layer connected to the first region. Accordingly, direct current resistance can be reduced.

The base body may include a mounting surface, an upper surface opposite the mounting surface, and end surfaces that are adjacent to the mounting surface and the upper surface and are opposite each other, and at least part of the end portion of the extended portion may be exposed from the end surface.

The term "step" used herein denotes not only an independent step but also includes a connotation of a step that can achieve a predetermined purpose thereof even when the step cannot be clearly distinguished from another step. Embodiments of the present disclosure are described below with reference to the drawings. The embodiments below each take an inductor for embodying the technical concept of the present disclosure as an example and the present disclosure is not limited to the inductors described below. The members recited in the aspects of the present disclosure are not limited to the members in the embodiments. In particular, the dimensions, materials, shapes, relative arrangements, and the like of the components described in the embodiments are not intended to limit the scope of the present disclosure only thereto but are mere examples for explanation as long as no specific descriptions are provided. In the drawings, the same references are given to the same elements. Although the embodiments are described separately for convenience in view of ease in explanation or understanding of the main points, the elements presented in different embodiments may be partially replaced or combined. In the second embodiment, the descriptions of the matters in common with those in the first embodiment are omitted and only different points are described. In particular, similar actions and effects by a similar structure are not mentioned in each embodiment.

EMBODIMENTS

The present disclosure is described in embodiments in detail below. The present disclosure is not limited to these embodiments, however.

First Embodiment

Figure 2:
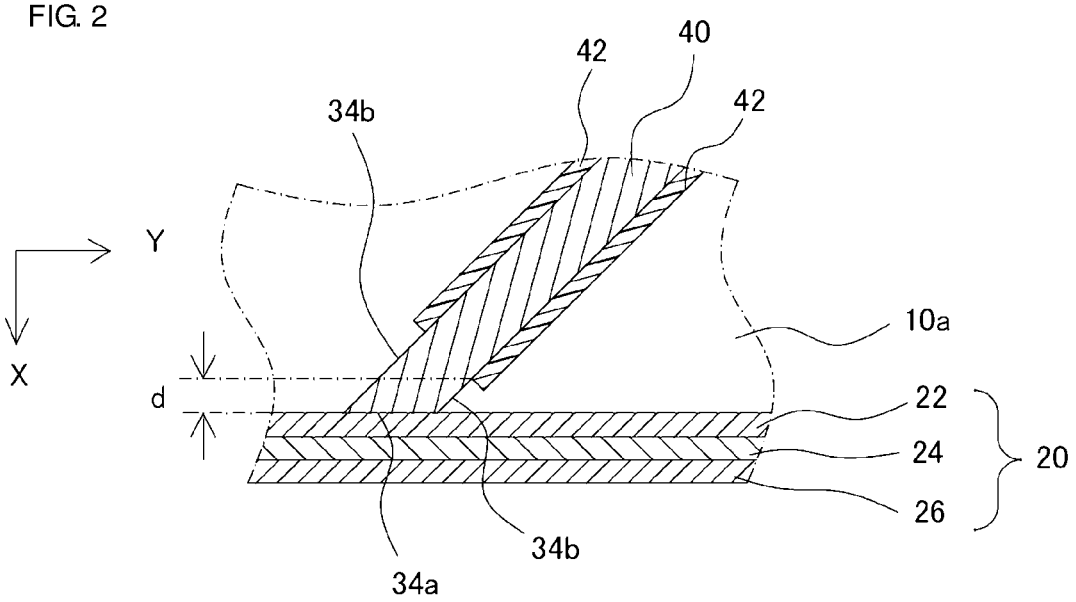
FIG. 2 is a partial cross-sectional view illustrating a plane that is taken along line A-A in FIG. 1 and parallel to the mounting surface.

An inductor 100 according to the first embodiment is described with reference to FIGS. 1 and 2. FIG. 1 is a partial transparent perspective view taken from the side of a mounting surface 12 of the inductor 100. FIG. 2 is a partial cross-sectional view illustrating a plane that is taken along line A-A in FIG. 1 and parallel to the mounting surface.

As illustrated in FIG. 1, the inductor 100 includes a coil 30, a base body 10, which envelops the coil 30 and is constituted by a magnetic body, and an outer electrode 20, which is arranged on a surface of the base body 10. The base body 10 has a substantially rectangular parallelepiped shape defined by a height T in the Z axis direction, which is substantially perpendicular to the mounting surface, and a length L in the X axis direction and a width W in the Y axis direction, which are substantially parallel to the mounting surface and substantially perpendicular to each other. The base body 10 includes the mounting surface 12, an upper surface 14, which is opposite the mounting surface 12, a pair of end surfaces 16, which are opposite each other and positioned so as to be adjacent to the mounting surface 12 and the upper surface 14, and a pair of side surfaces, which are opposite each other and positioned so as to be adjacent to the mounting surface 12, the upper surface 14, and the end surfaces 16. The end surfaces 16 of the base body 10 are positioned so as to be substantially perpendicular to the X axis direction. The magnetic body that constitutes the base body 10 is made from a compound material that contains magnetic powder and resin and is formed by embedding a coil in the compound material by press forming. As the magnetic powder, iron-based metallic magnetic powder, such as Fe, Fe—Si—Cr, Fe—Ni—Al, Fe—Cr—Al, Fe—Si, Fe—Si—Al, Fe—Ni, or Fe—Ni—Mo, metallic magnetic powder based on another composition, metallic magnetic powder, such as amorphous, metallic magnetic powder whose surface is covered with an insulator such as glass, metallic magnetic powder whose surface is reformed, or nano-level minute metallic magnetic powder is used. As the resin, thermosetting resin, such as epoxy resin, polyimide resin, or phenol resin, or thermoplastic resin, such as polyethylene resin or polyamide resin is used.

The coil 30 is formed using a conductor (so-called a substantially rectangular wire) 40 that has a coating layer 42 and includes a pair of wide surfaces opposite each other and side surfaces adjacent to the pair of wide surfaces. The coil 30 includes a winding portion 32 and an extended portion 34 extended from an outer peripheral portion of the winding portion 32. The winding portion 32 is formed by winding the conductor 40 into a substantially spiral shape having upper and lower two stages so that the wide surfaces of parts of the conductor 40 face each other in a state where both end portions of the conductor 40 are positioned in an outermost peripheral portion while the conductor 40 is continuous in an innermost peripheral portion. The extended portions 34 are formed so as to be continuous from both of the end portions of the conductor 40 positioned in the outer peripheral portion of the winding portion 32 and extended in the directions to the end surfaces 16 of the base body 10. In the end portion of the extended portion 34, a conductor portion from which the coating layer 42 is removed is formed and the conductor portion includes a first region 34*a* exposed from the end surface 16 of the base body 10 and a second region 34*b* formed so as to be continuous with the first region 34*a* and in contact with the magnetic body. In the inductor 100, the first region 34*a* constitutes an end surface of the extended portion 34 that intersects the length direction of the conductor 40 and is electrically connected to the outer electrode 20. The outer electrodes 20 are arranged so as to extend from the end surfaces 16 to the mounting surface 12 of the base body 10. On the surface of the base body 10 except the region where the outer electrodes 20 are arranged, exterior resin may be arranged.

The cross section substantially perpendicular to the length direction of the conductor 40 that constitutes the coil 30 has, for example, a substantially rectangular shape and is defined by the width of a wide surface corresponding to a longer side of the substantially rectangular shape and the thickness that corresponds to a shorter side of the substantially rectangular shape and is a distance between the wide surfaces. The conductor 40 is formed so that its width is, for example, about 120 μm or more and about 350 μm or less (i.e., from about 120 μm to about 350 μm) and its thickness is, for example, about 10 μm or more and about 150 μm or less (i.e., from about 10 μm to about 150 μm). The coating layer 42 of the conductor 40 is formed of insulative resin, such as polyamide-imide, which has a thickness of, for example, about 2 μm or more and about 10 μm or less (i.e., from about 2 μm to about 10 μm), and preferably about 6 μm. On the surface of the coating layer 42, a self welding layer containing a self welding ingredient, such as thermoplastic resin or thermosetting resin, may be further provided, which may be formed so that its thickness is about 1 μm or more and about 3 μm or less (i.e., from about 1 μm to about 3 μm).

As illustrated in FIG. 2, in the end portion of the conductor 40, the coating layer 42 is removed and the first region 34*a*, which is exposed from the surface of the base body, and the second region 34*b*, which is in contact with a magnetic body 10*a*. The first region 34*a* is an end surface that intersects the length direction of the conductor 40 and the end surface is formed so as to be inclined with respect to the length direction of the conductor 40 rather than being substantially perpendicular. In the inductor 100, the coating layer 42 is removed from an outer peripheral portion of the first region 34*a*, which is a region of the exposure from the base body of the conductor 40, and the outer peripheral portion of the first region 34*a* is in contact with the magnetic body 10*a*. Accordingly, in a case where an outer electrode is formed on the surface of the base body by plating, the plating layer formed on the surface of the base body and the plating layer formed on the first region 34*a* can be connected easily even when the plating layers are thin. In FIG. 2, the coating layer 42 is removed along all the edges of the cross section that is substantially perpendicular to the length direction of the conductor 40 and the second region 34*b* is formed on the pair of wide surfaces and the side surfaces of the conductor 40. That is, the second region 34*b* is formed so as to surround the conductor 40.

The second region 34*b* may be formed in a position in which a depth d from the surface of the base body in a plane where the first region 34*a* is exposed is larger than the value of an average particle diameter D50 of the magnetic powder contained in the base body. In other words, the depth d of the second region 34*b* of the conductor portion from the surface of the base body is larger than the value of the average particle diameter D50 of the magnetic powder. Accordingly, the outer peripheral portion of the first region 34*a* can be in direct contact with the magnetic powder contained in the magnetic body 10*a* and the area for plating is increased. As a result, the plating can grow fast. Herein, the depth d from the surface of the base body is a distance between the surface of the base body and the position in which the second region 34*b* comes into contact with the coating layer 42, and denotes a minimum value in the direction of the normal of the plane where the first region 34*a* is exposed. The average particle diameter D50 of the magnetic powder is a particle diameter corresponding to 50% of the volume accumulation from the side of the minor diameter in a volume-based particle size distribution of the magnetic powder. The average particle diameter D50 of the magnetic powder may be, for example, about 1 μm or more and about 80 μm or less (i.e., from about 1 μm to about 80 μm). The depth d of the second region 34*b* may be, for example, about 1 μm or more and be smaller than or equal to a half of the length of the extended portion 34.

As illustrated in FIG. 2, the outer electrode 20 includes, for example, a first plating layer 22 formed so as to be connected to the first region 34*a*, a second plating layer 24 formed on the first plating layer 22, and a third plating layer 26 formed on the second plating layer 24. For example, the first plating layer 22 may contain copper, the second plating layer 24 may contain nickel, and the third plating layer 26 may contain tin.

Manufacturing Method of Inductor

A manufacturing method of the inductor 100 includes, for example, a preparation step in which a coil with a desired shape is prepared, a coating layer removal step in which the coating layer in an end portion of an extended portion of the prepared coil is removed to form a conductor portion, a compacting step in which the coil is embedded in a magnetic powder containing sheet to form a sheet-like base body, a separation step in which the sheet-like base body is separated by cutting with a dicing machine to obtain a separated base body, and an electrode formation step in which an outer electrode is formed on a surface of the base body.

In the preparation step, a coil is prepared that includes a winding portion where a conductor having a coating layer is wound into a two-stage substantially spiral shape so as to be continuous at the innermost periphery, and a pair of extended portions extended from the outermost periphery of the winding portion. In the coating layer removal step, the coating layer is removed from the end portions of both extended portions and a conductor portion is formed in each of the end portions. The coating layer can be removed by, for example, laser irradiation, a cutter, or chafing with a file or the like.

In the compacting step, the coil is arranged on a magnetic powder containing sheet made from a prepared compound material that contains magnetic powder and resin, and then covered with another magnetic powder containing sheet to undergo pressurization. Accordingly, a sheet-like base body where the coil is embedded in the magnetic powder containing sheet is obtained. At this time, a plurality of coils may be aligned on the magnetic powder containing sheet. Further, in the compacting step, thermosetting resin may be used as the resin and solidified through heating at the time of the pressurization.

In the separation step, the sheet-like base body is cut with a dicing machine across the conductor portion so that the conductor portion in the end portion of the extended portion of each coil embedded in the sheet-like base body remains in an expected separated base body, and the separated base body is obtained. Exterior resin is coated on the surface of the separated base body. After that, by laser irradiation, a region where an outer electrode is arranged is formed by causing the exterior resin on the surface of the base body, which includes a portion where the end portion of the extended portion is exposed, to fall off.

In the electrode formation step, in the portion where the end portion of the extended portion is exposed, for example, a first plating layer is formed by barrel plating to form the outer electrode. The first plating layer may contain copper for example. On the first plating layer, when necessary, a second plating layer and a third plating layer may be formed.

In the portion where the end portion of the extended portion is exposed on the surface of the base body, the coating layer of the conductor is not exposed and the exposed conductor portion is in contact with the magnetic body that constitutes the base body. Thus, the coating layer can bring no separation on the junction between the plating layer formed on the surface of the base body and the plating layer formed on the conductor portion. Accordingly, even when the thickness of a plating layer is decreased, an outer electrode can be formed easily and the productivity of the inductor can be enhanced.

Figure 3:
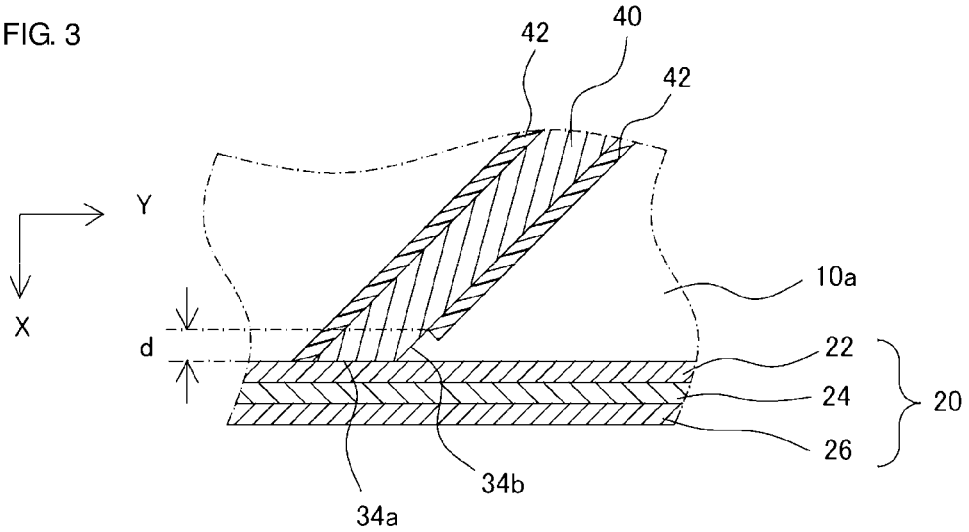
FIG. 3 is a partial cross-sectional view illustrating a plane that is taken along line A-A in FIG. 1 and parallel to the mounting surface according to a variation of the first embodiment.

A variation of the inductor 100 is described with reference to FIG. 3. FIG. 3 is a partial cross-sectional view of the inductor 100 according to the variation, which is taken along line A-A in FIG. 1 and on a plane corresponding to a plane substantially perpendicular to the winding axis of the coil. The inductor according to the variation has a structure similar to that of the inductor 100 except that, in the end portion of the extended portion, the conductor portion from which the coating layer is removed is formed only on one of the wide surfaces of the conductor.

As illustrated in FIG. 3, the conductor portion from which the coating layer is removed is formed on the wide surface of the conductor that faces the surface of the base body of the extended portion. In the inductor according to the variation, it is unnecessary to remove the coating layer along all the edges of the cross section that is substantially perpendicular to the length direction of the conductor in the end portion of the extended portion. Thus, productivity can be further enhanced. The wide surface where the coating layer is removed is the wide surface on the side of continuity with the outer peripheral surface of the winding portion. Accordingly, in removing the coating layer, obstruction by the presence of the winding portion or damage on the coating layer of the winding portion can be inhibited. In the inductor according to the variation, the coating layer that covers the side surface of the conductor may be removed concurrently.

Second Embodiment

Figure 4:
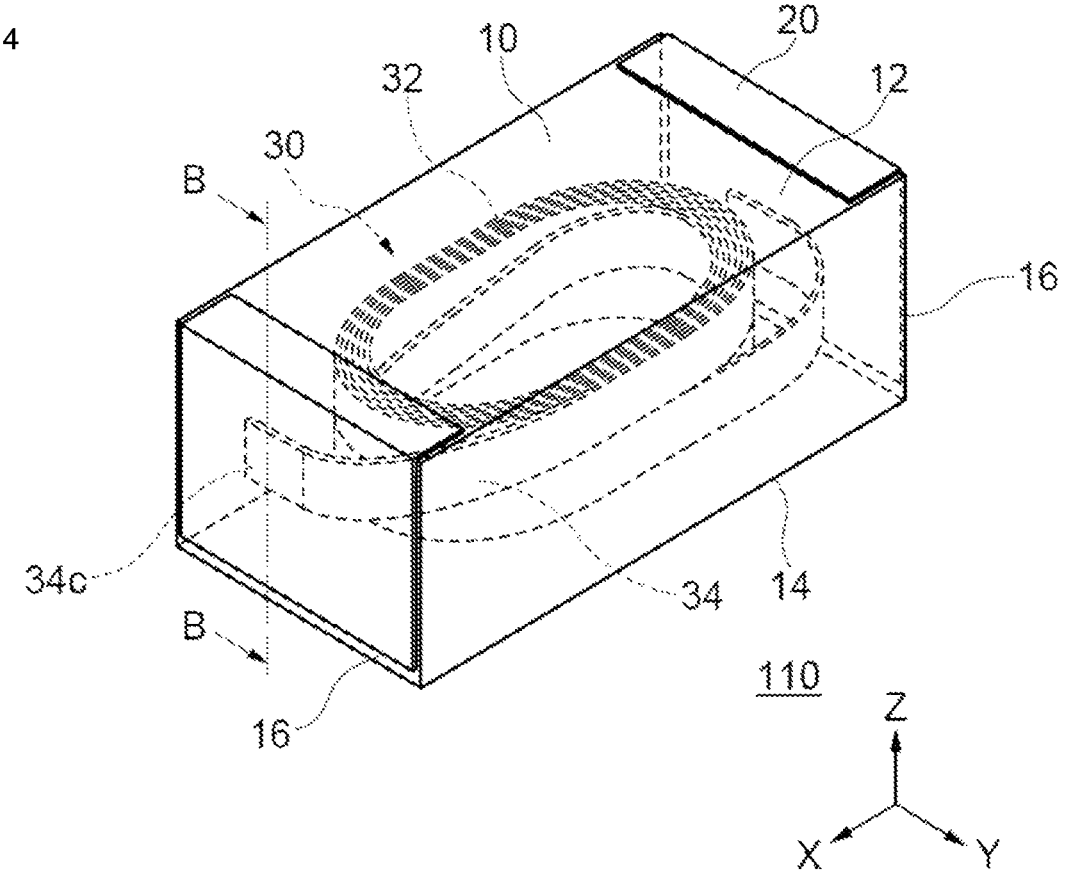
FIG. 4 is a partial transparent perspective view taken from the side of a mounting surface of an inductor according to a second embodiment.
Figure 5:
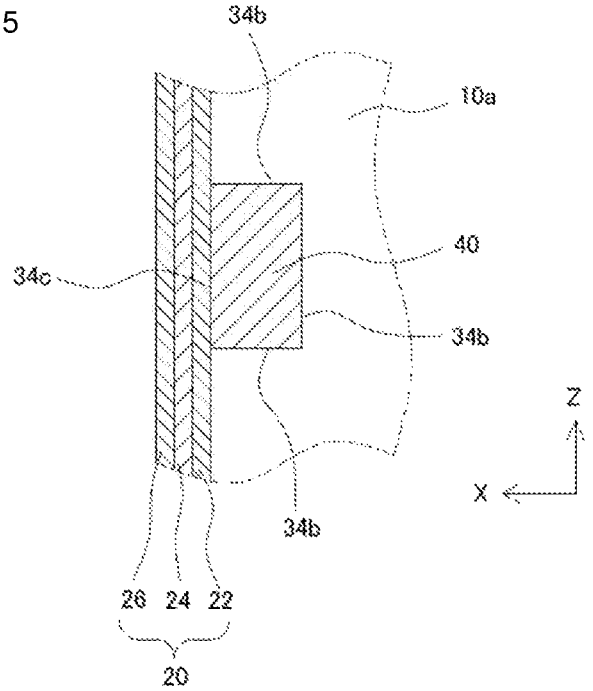
FIG. 5 is a partial cross-sectional view illustrating a plane that is taken along line B-B in FIG. 4 and substantially perpendicular to an end surface of a base body.

An inductor 110 according to a second embodiment is described with reference to FIGS. 4 and 5. FIG. 4 is a partial transparent perspective view taken from the side of a mounting surface of the inductor 110. FIG. 5 is a partial cross-sectional view illustrating a plane that is taken along line B-B in FIG. 4 and substantially perpendicular to an end surface 16 of a base body 10. The inductor 110 has a structure similar to that of the inductor 100 except that each wide surface in an end portion of an extended portion 34 is exposed to the end surface 16 of the base body 10.

As illustrated in FIG. 4, the extended portions 34 of the inductor 110 are formed so as to be continuous from both end portions of a conductor 40 positioned in an outer peripheral portion of a winding portion 32 and extended in the directions to the end surfaces 16 of the base body 10. In the end portion of the extended portion 34, a conductor portion from which the coating layer is removed is formed and the wide surfaces of the conductor portion are arranged along the end surface 16 of the base body 10, and one of the wide surfaces is exposed from the end surface 16 and a first region 34*c* is formed. As illustrated in FIG. 5, in the inductor 110, the coating layer is removed from the end portion of the extended portion 34 along all the edges of the cross section that is substantially perpendicular to the length direction of the conductor 40, and the conductor portion is formed. Accordingly, the wide surface that faces the first region 34*c* of the conductor portion and the side surface of the conductor portion come into contact with the magnetic body 10*a* to constitute a second region 34*b*.

Figure 6:
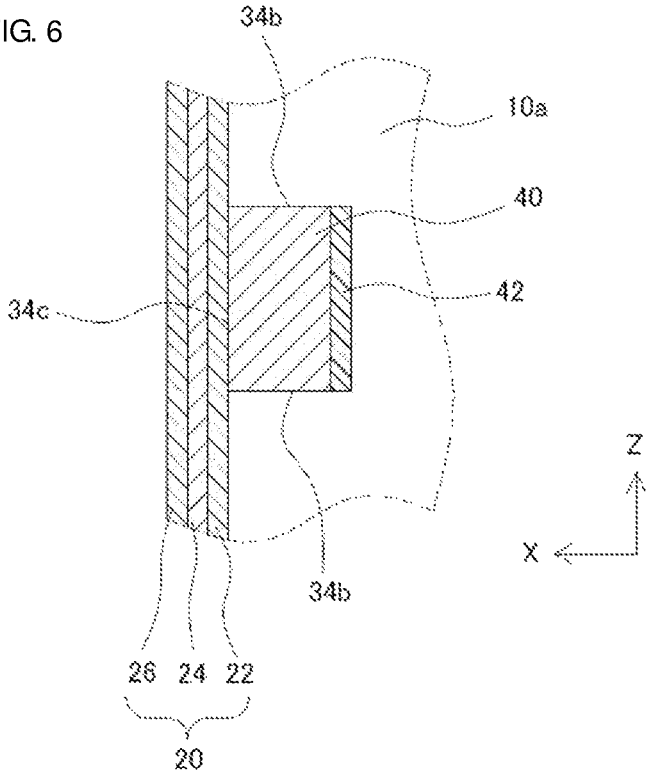
FIG. 6 is a partial cross-sectional view illustrating a plane that is taken along line B-B in FIG. 4 and substantially perpendicular to the end surface of the base body according to a variation of the second embodiment.

A variation of the inductor 110 is described with reference to FIG. 6. FIG. 6 is a partial cross-sectional view illustrating a plane that is taken along line B-B in FIG. 4 and substantially perpendicular to an end surface of the base body in the inductor according to the variation. The inductor according to the variation has a structure similar to that of the inductor 110 except that, in the end portion of the extended portion, the conductor portion from which the coating layer is removed is formed on one of the wide surfaces and both side surfaces of the conductor.

As illustrated in FIG. 6, the conductor portion from which the coating layer is removed is formed on the wide surface of the conductor on the side facing the surface of the base body of the extended portion and on the side surfaces of the conductor. In the inductor according to the variation, it is unnecessary to remove the coating layer along all the edges of the cross section that is substantially perpendicular to the length direction of the conductor in the end portion of the extended portion. Thus, productivity can be further enhanced. The wide surface where the coating layer is removed is the wide surface on the side of continuity with the outer peripheral surface of the winding portion. Accordingly, in removing the coating layer, obstruction by the presence of the winding portion or damage on the coating layer of the winding portion can be inhibited.

In the above-described embodiments and variations, the base body has a substantially rectangular parallelepiped shape. Each of the sides that form the rectangular parallelepiped shape may be chamfered. When viewed in a winding axis direction, the winding portion of the coil may have a substantially circular shape, a substantially elliptical shape, a substantially oval shape, a substantially polygonal shape, or the like. The winding portion may have a shape different from so-called alpha winding, which is a shape of edgewise winding for example. The side surfaces of the conductor may be flat or curved.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a coil including a winding portion, in which a conductor having a coating layer is wound, and an extended portion extended from the winding portion;

a base body that contains the coil and is constituted by a magnetic body containing magnetic powder and resin; and an outer electrode that is arranged on a surface of the base body and connected to the extended portion, wherein the extended portion includes a conductor portion that is without the coating layer in an end portion of the extended portion, the conductor portion includes a first region connected to the outer electrode and a second region in contact with the magnetic body, and a depth of the second region of the conductor portion from a surface of the base body is larger than a value of an average particle diameter D50 of the magnetic powder.

2. The inductor according to claim 1, wherein the conductor portion includes the first region on a surface of the conductor that intersects a length direction of the conductor.

3. The inductor according to claim 2, wherein the second region includes a region in which the magnetic powder is in contact with the conductor.

4. The inductor according to claim 2, wherein the outer electrode includes a copper plating layer connected to the first region.

5. The inductor according to claim 2, wherein the base body includes a mounting surface, an upper surface opposite to the mounting surface, and end surfaces that are adjacent to the mounting surface and the upper surface and are opposite to each other, and at least a portion of the end portion of the extended portion is exposed from one of the end surfaces.

6. The inductor according to claim 1, wherein the conductor portion includes the first region on a surface of the conductor that extends in a length direction of the conductor.

7. The inductor according to claim 6, wherein the second region includes a region in which the magnetic powder is in contact with the conductor.

8. The inductor according to claim 6, wherein the outer electrode includes a copper plating layer connected to the first region.

9. The inductor according to claim 6, wherein the base body includes a mounting surface, an upper surface opposite to the mounting surface, and end surfaces that are adjacent to the mounting surface and the upper surface and are opposite to each other, and at least a portion of the end portion of the extended portion is exposed from one of the end surfaces.

10. The inductor according to claim 1, wherein the second region includes a region in which the magnetic powder is in contact with the conductor.

11. The inductor according to claim 10, wherein the outer electrode includes a copper plating layer connected to the first region.

12. The inductor according to claim 10, wherein the base body includes a mounting surface, an upper surface opposite to the mounting surface, and end surfaces that are adjacent to the mounting surface and the upper surface and are opposite to each other, and at least a portion of the end portion of the extended portion is exposed from one of the end surfaces.

13. The inductor according to claim 1, wherein the outer electrode includes a copper plating layer connected to the first region.

14. The inductor according to claim 1, wherein the base body includes a mounting surface, an upper surface opposite to the mounting surface, and end surfaces that are adjacent to the mounting surface and the upper surface and are opposite to each other, and at least a portion of the end portion of the extended portion is exposed from one of the end surfaces.

* * * * *